United States Patent [19]

Davis, Jr.

[11] Patent Number: 5,054,200

[45] Date of Patent: Oct. 8, 1991

[54] DOUBLE-BLADED COMBAT WEAPON

[76] Inventor: James P. Davis, Jr., 2214 Strasbourg Ct., Orlando, Fla. 32808

[21] Appl. No.: 569,198

[22] Filed: Aug. 20, 1990

[51] Int. Cl.[5] ..... B26B 3/00; B26B 27/00; B26B 3/06

[52] U.S. Cl. ..... 30/152; 30/155; 30/161

[58] Field of Search ..... 30/125, 162, 136, 134, 30/152, 154, 155, 298, 299, 304, 160, 161

[56] References Cited

U.S. PATENT DOCUMENTS

| | | | |
|---|---|---|---|
| 2,276,026 | 3/1942 | Davidson, Jr. | 30/154 |
| 2,441,475 | 5/1948 | Di Veglia | 30/299 |
| 2,820,291 | 1/1958 | Philippar | 30/299 |
| 3,791,033 | 2/1974 | Regan | 30/155 |
| 4,096,629 | 6/1978 | Levine | 30/298 |
| 4,356,631 | 11/1982 | Guth | 30/154 |
| 4,730,394 | 3/1988 | Sonner, Jr. | 30/155 |
| 4,893,409 | 1/1990 | Poehlmann | 30/155 |

*Primary Examiner*—Douglas D. Watts
*Assistant Examiner*—Paul M. Heyrana, Sr.
*Attorney, Agent, or Firm*—Macdonald J. Wiggins

[57] ABSTRACT

A double-bladed combat weapon includes a handle having slotted ends. A knife blade having a semicircular tang, which has a plurality of index notches, is pivotally disposed in each slotted end of the handle. An indexing mechanism is disposed in each end of the handle and engages one the index notches of the blade tang. A release for each blade is provided to permit the user to swing the blades selectively from a rearwardly directed position to a forwardly directed position, as well as intermediate positions during combat.

15 Claims, 2 Drawing Sheets

DOUBLE-BLADED COMBAT WEAPON

BACKGROUND OF THE INVENTION

1. Field of the Invention

The present invention relates to hand combat weapons, and more particularly to a two bladed weapon configurable as a knife.

2. Description of the Prior Art

Double-bladed devices are known in the prior art. Clement, in U.S. Pat. No. 238,854 teaches a knife in which a pair of blades can be folded rearwardly. Di Veglia, U.S. Pat. No. 2,441,475 discloses a knife having a pair of blades folding into a handle. Thomsen, U.S. Pat. No. 1,530,796, and Merkle, U.S. Pat. No. 608,337, show two-blade adjustable spacing knives for food products. Other related U.S. patents include Levine, U.S. Pat. No. 4,096,629, and Eckerle, U.S. Pat No. 4,608,757.

None of the known art relates to a double-bladed weapon in which the blades can be selectively extended, retracted, or moved to a lateral position during use. A weapon of such type may provide both defensive and offensive uses.

SUMMARY OF THE INVENTION

The present invention is a double-bladed weapon having a handle to be gripped in one hand. A slot at each end of the handle accepts various types of blades. A preferred blade is a single edged knife blade. The tang end of a blade is semicircular and includes positioning notches. A hole at the center of the semicircular end permits blades to be mounted in each of the slots by means of pivot screws, thus allowing changes of blades. A pair of push buttons is disposed in the handle that controls detents which engage the blade notches. Alternatively, a short lever may be used to control the detents.

A user grips the weapon by the handle. For defensive purposes, the two blades may extend rearwardly, and essentially parallel with the user's arm. The blades may be used to deflect or intercept a blow from an opponent's weapon by raising the forearm. When an attack is to be made, either or both buttons may be depressed, releasing the detents. With a motion of the arm, the blades may be swung outward to either a laterally extending, or forward extending, position. Releasing the buttons permits the detents to lock the blades in the new orientations.

Other types of blades that may be selectively installed in the handle include: a blade with a sawtooth edge; an elongate spike; a double-edge knife blade; and a soft plastic or rubber blade for training purposes.

It is therefore a principal object of the invention to provide a double-bladed weapon to be held in the user's hand in which the blades thereof can be quickly moved from a defensive position to an offensive position during an attack.

It is another object of the invention to provide a double-bladed weapon having a pair of knife blades pivotally mounted at the ends of a handle, and in which the handle includes means for releasing and locking the blades in various positions while the weapon is in use.

It is still another object of the invention to provide a double-bladed weapon in which one type of blade can be removed from a handle and replaced with a different type of blade.

These and other objects and advantages will become apparent from the following detailed description when read in conjunction with the drawings.

DETAILED DESCRIPTION OF THE PREFERRED EMBODIMENT

Figure 1:
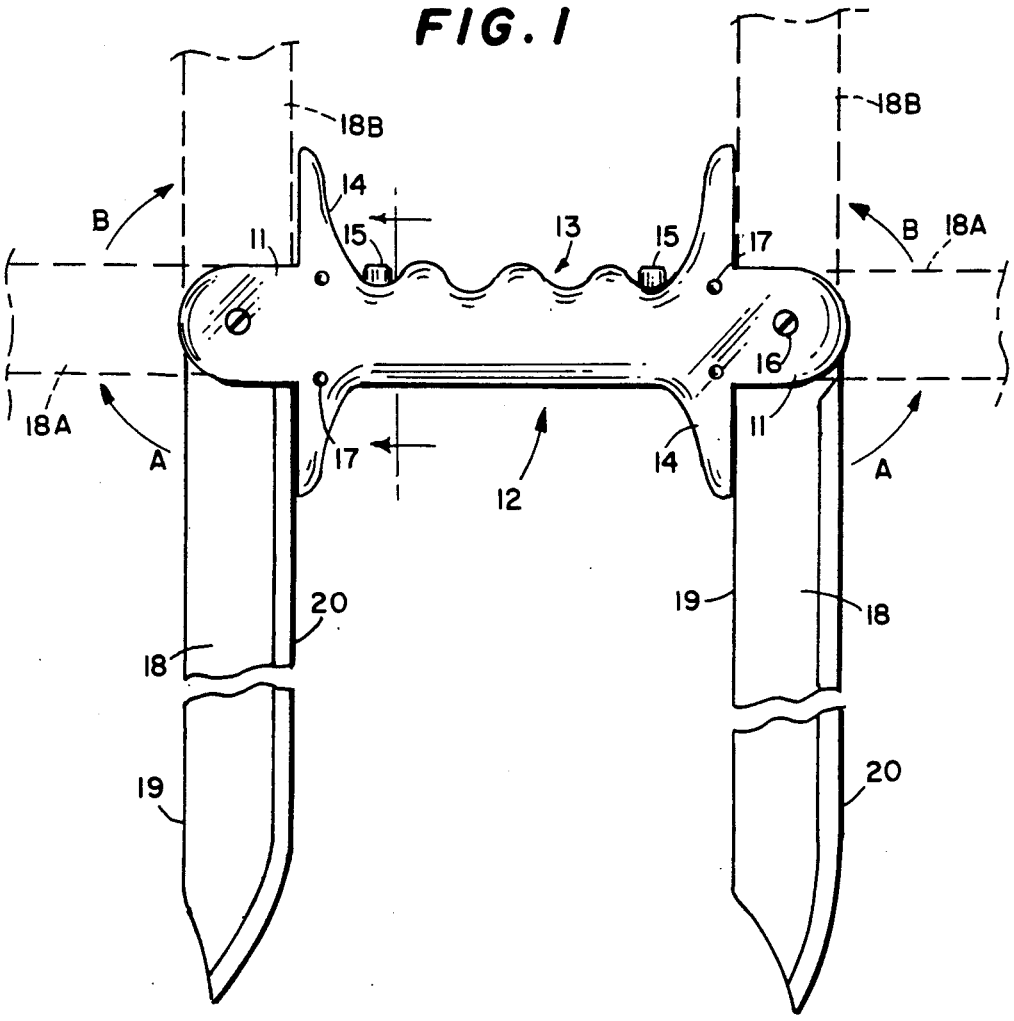
FIG. 1 is a plan view of the double-bladed weapon of the invention showing the blades in a defensive position.
Figure 2:
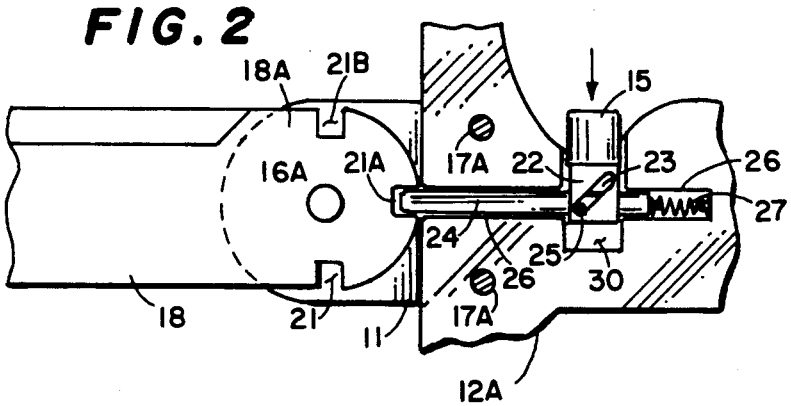
FIG. 2 is a partial view of the handle and blade of FIG. 1 with one half of the handle portion removed to show a blade locking and release mechanism.

Referring to FIG. 1, a weapon 10 in accordance with the invention is shown having a handle 12, and a pair of blades 18. Handle 12 is formed of two pieces, 12A and 12B seen in cross section in FIG. 3, held together by rivets 17, or like fasteners. Hand guards 14 are provided at each end of handle 12 to protect the user from the blades, and to provide a stop for the blades in the rearward and forward positions. The outer ends 11 of handle halves 12A, 12B form a slot to accept the tang ends of blades 18, which are secured with a removable pivot screw 16. As shown in FIG. 2, the tang end 18A is semicircular, and includes a plurality of indexing notches 21, and pivot hole 16A. A detent rod 24 is disposed in channel 26 of handle 12A, and of 12B (not shown), and biased to engage a notch, such as 21A, by a spring 27.

As will be understood, blades 18 may be locked in a plurality of positions determined by the number of index notches 21. For exemplary purposes, three notches 21, 21A and 21B are shown that permit rearward, lateral, and forward positions. Handle 12, as shown in FIG. 1, is preferably fitted to the hand and includes a set of finger grooves 13. In one embodiment of the invention, a push button 15 is disposed in each of the left and right outer grooves 13, and are operable by finger pressure thereon.

Figure 3:
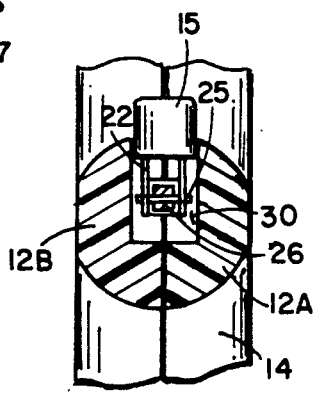
FIG. 3 is a cross-sectional view of the handle portion in the plane 3—3 of FIG. 1.

As shown in FIGS. 2 and 3, push button 15 is attached to a pair of tabs 22 having angled slots 23. A pin through detent rod 26 engages slots 23. As may be noted, downward pressure on button 15, as indicated by the arrow, causes detent rod 26 to move to the right in FIG. 2, compressing spring 27. This action releases blade 18 to permit moving to a different position relative to handle 12. Releasing pressure on button 15 permits detent rod 24 to engage another notch 21.

In FIG. 1, blades 18 are indicated with one knife blade having its blunt edge 19, in the rearwardly extending positions shown, outwardly oriented, and the other blade 19 reversed to have the sharp edge outward. As will be understood, pivot screw 16 can be removed and the blade 19 reversed. Generally, it is preferred for defensive purposes, that both blades be turned with the sharp edges outward. A blade 19 can be used to protect the arm of a user by catching an attacking weapon on the sharp edge 20. When the user wishes to attack, either or both buttons 15 may be depressed, and blades 18 swung to position 18A or 18B as shown by arrows A and B, and buttons 15 released to lock the blades in the new positions. With practice, a user may learn to quickly control the blades 18 to the most advantageous positions during combat.

Figure 4:
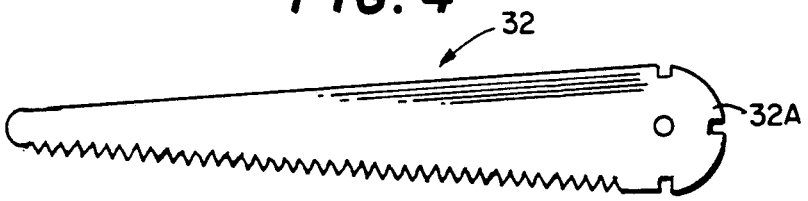
FIG. 4 is a plan view of a saw tooth blade for use in the weapon of FIG. 1.
Figure 5:
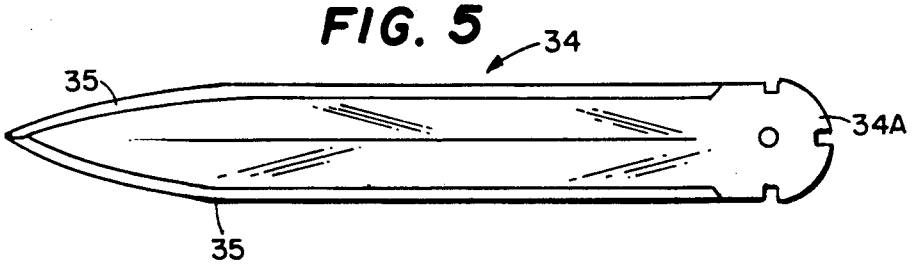
FIG. 5 is a plan view of a double edge knife blade for use in the weapon of FIG. 1.
Figure 6:
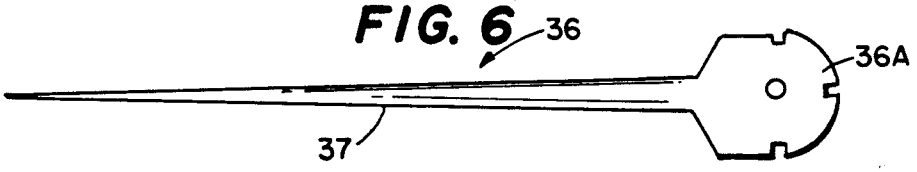
FIG. 6 is a plan view of a spike type blade for use in the weapon of FIG. 1.

As discussed above, pivot screws 16 are removable to permit changing of blades. For example, blades 18 may be removed and alternative types of blades installed. FIGS. 4, 5, and 6 show typical types of blades usable with the invention. A blade 32 in FIG. 4 has a saw tooth edge 33; a blade 34 in FIG. 5 is a double edged knife blade; and FIG. 6 shows a spike type blade 36 having an elongate pointed end 37. It is to be understood that it is not necessary to have the same type of blade installed at each end of handle 12.

Figure 7:
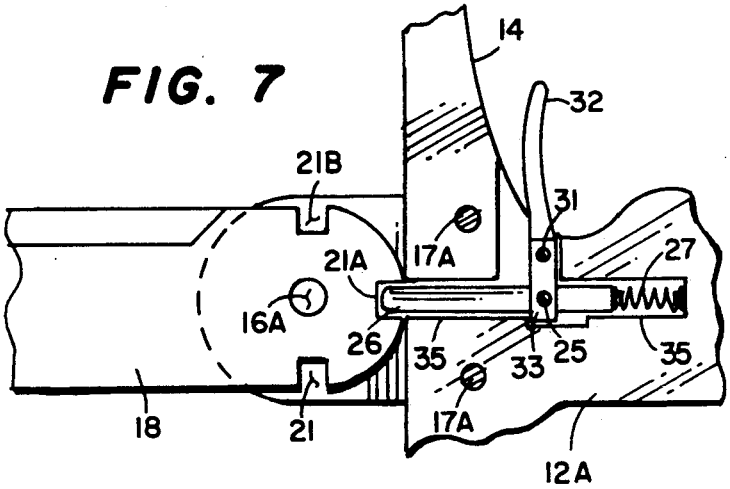
FIG. 7 is a partial view of the handle and blade of FIG. 1 with one half of the handle portion removed to show an alternative locking and releasing mechanism.
Figure 8:
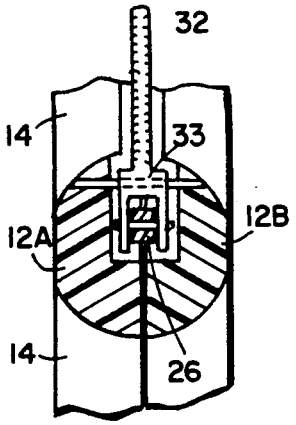
FIG. 8 is a cross-sectional view of the mechanism of FIG. 7.

An alternative release means for detent rod 26 is shown in FIGS. 7 and 8. In FIG. 7, handle half 12A is shown with detent rod 26 disposed in channel 35, and biased toward notch 21A by spring 27. A lever 32 is pivoted by pin 31, and includes a yoke portion 33 straddling detent rod 35. A second pivot pin 25 connects yoke portion 33 to detent rod 26. During use of the weapon 10, the user may press lever 32 in the direction of the arrow, withdrawing detent rod 26 from notch 21A, permitting change of position of blade 18.

Handle 12 is preferably formed from metal, such as steel, aluminum, or brass to ensure sufficient strength. For training weapons, Plastic or similar material may be used for handle 12. Blades 18, 32, 24, and 36 may be made from metal, preferably tool steel, or similar materials that can be hardened and will maintain sharp edges. The blades may also be made from a soft material, such as plastic or rubber material, for training and practice in using the weapon.

As will now be recognized, a new and novel weapon for hand-to-hand combat has been disclosed that may be used to defend against attacks with blade type weapons, and for offensive attacks. The weapon of the invention is versatile, and may be configured in a number of modes, and adjusted quickly during use to provide an optimum conformation.

Although a specific implementation of the invention has been shown, such is for exemplary purposes only. Various changes in materials, configuration, and blades may be made without departing from the spirit and scope of the invention.

I claim:

1. A combat weapon comprising:

a handle for gripping by a user's hand, said handle having a slot in each end for receiving a tang of a blade;

a pair of blades, each having a semicircular tang, each of said tangs having a plurality of index notches in a periphery thereof;

a pair of pivot screws for rotatably securing said blades in said slots;

indexing means disposed in said handle for selectively engaging one of said index notches of each of said blades; and indexing operating means for permitting a user to selectively release and engage said index notches during combat.

2. The weapon as defined in claim 1 in which said handle includes finger grip grooves along a front edge thereof.

3. The weapon as defined in claim 1 in which said pivot screws are removable to permit changing of said blades.

4. The weapon as defined in claim 1 in which:

said indexing means includes a detent rod disposed in a channel within said handle, said rod biased toward one of said tangs for engaging one of said notches; and said indexing operating means includes a push button disposed within said handle and coupled to said detent rod, wherein depressing said push button withdraws said detent rod from one of said notches.

5. The weapon as defined in claim 1 in which:

said indexing means includes a detent rod disposed in a channel within said handle, said rod biased toward one of said tangs for engaging one of said notches; and said indexing operating means includes a lever pivoted within said handle and coupled to said detent rod, wherein pressure on said lever withdraws said detent rod from one of said notches.

6. A double bladed, hand held weapon having interchangeable blades, comprising:

a) a handle having a hand guard at each end thereof, and a slotted outer end projecting from said hand guards, each of said outer ends including a first pivot hole;

b) a pair of removable blades, each of said blades having a semicircular tang, a second pivot hole at a center of said semicircular tang, and a plurality of indexing notches around the periphery of said tang;

c) a pivot screw removably inserted through said first pivot hole of said handle end, and said second pivot hole of said tang, said pivot screw removable for interchanging blades; and d) indexing and index releasing means in said handle for permitting a user, during combat, to selectively engage and disengage said indexing notches of said tangs to thereby permit changing of positions of said blades.

7. The weapon as defined in claim 6 in which said indexing notches are arranged to permit said blades to be selectively indexed to a rearward position, a lateral position, or a forward position.

8. The weapon as defined in claim 6 in which:

said indexing means includes a detent rod disposed in a channel within said handle, said rod biased toward one of said tangs for engaging one of said notches; and said release and operating means includes a push button disposed within said handle and coupled to said detent rod, wherein depressing said push button withdraws said detent rod from one of said notches.

9. The weapon as defined in claim 6 in which:

said indexing means includes a detent rod disposed in a channel within said handle, said rod biased toward one of said tangs for engaging one of said notches; and said release and operating means includes a lever pivoted within said handle and coupled to said detent rod, wherein pressure on said lever withdraws said detent rod from one of said notches.

10. The double bladed combat weapon as defined in claim 6 in which said pair of removable blades is selected from the group consisting of a single edge knife blade, a double edge knife blade, a saw tooth edge blade, and a spike type blade, each of said blades having a semicircular tang, each of said tangs having at least three indexing notches therein, and a pivot screw hole therethrough.

11. A hand-to-hand combat weapon comprising:

a handle;

a first knife-like blade pivotally attached to a first end of said handle;

a second knife-like blade pivotally attached to a second end of said handle;

indexing means in said handle for maintaining said first and second blades each in one of a plurality of positions relative to said handle; and indexing control means, operable by a user during combat, for selectively changing positions of said first and second blades.

12. The weapon as defined in claim 11 in which each of said blades is removable from said handle for interchanging of blades.

13. The weapon as defined in claim 11 in which:

said indexing means includes a semicircular, pivoted end of each of said blades having a plurality of notches therein, and an operable detent associated with each of said blades for selectively engaging one of said notches; and said indexing control means includes manually operable actuators for selectively releasing and engaging each of said detents.

14. The weapon as defined in claim 13 in which said manually operable actuators are buttons disposed in said handle, and operable by user during combat.

15. The weapon as defined in claim 13 in which said manually operable actuators are levers disposed in said handle, and operable by user during combat.

* * * * *